US005720081A

United States Patent [19]

Aquilina

[11] Patent Number: 5,720,081

[45] Date of Patent: Feb. 24, 1998

[54] TOOL HANDLE

[76] Inventor: Paul C. Aquilina, 1857 Old Mill Road, Kitchener, Ontario, Canada, N2P 1E3

[21] Appl. No.: 723,515

[22] Filed: Sep. 30, 1996

[51] Int. Cl.[6] ..... A47B 95/02

[52] U.S. Cl. ..... 16/114 R; 294/58

[58] Field of Search ..... 16/110 R, 111 R, 16/114 R, DIG. 41, DIG. 40; 294/57, 58, 59, 54.5

[56] References Cited

U.S. PATENT DOCUMENTS

| | | | |
|---|---|---|---|
| D. 269,490 | 6/1983 | Germain . | |
| 519,515 | 5/1894 | Walsh . | |
| 1,035,483 | 8/1912 | Scott . | |
| 1,594,900 | 8/1926 | Fine . | |
| 3,107,937 | 10/1963 | Duppengiesser . | |
| 4,050,728 | 9/1977 | Davidson | 294/58 |
| 4,794,667 | 1/1989 | Nelson et al. . | |

FOREIGN PATENT DOCUMENTS

| | | |
|---|---|---|
| 1327222 | 8/1973 | United Kingdom . |

*Primary Examiner*—Chuck Mah
*Attorney, Agent, or Firm*—D. Doak Horne

[57] ABSTRACT

A two-component tool handle, comprised of a yoke member having yoke arms and a grip member, constructed so as to allow the grip member to be lockingly secured to the yoke arms upon simple rotation of the grip member when inserted in yoke arms, to thereby lock the yoke arms together and thereby form a D-shaped tool handle. Detent means, preferably in the form of a protruding member on the grip member, and a recessed portion on the yoke arm members, or vice versa, are provided, which snap into engagement upon the grip member being rotated within the yoke arms from a first position to the third (locked) position.

12 Claims, 6 Drawing Sheets

TOOL HANDLE

FIELD OF INVENTION

This invention relates to a tool handle, and more particularly to a two-part tool handle consisting of a grip which may, upon rotation, be fixably secured to the yoke of the tool handle.

BACKGROUND OF THE INVENTION

Tool handle incorporating various means for fixably securing a grip member between two arms of a yoke member of a tool handle have been known for over 100 years.

Typical of these devices are the tool handles are the type disclosed in U.S. Pat. No. 519,515 and 4,794,667, which teach and describe a cylindrical grip member through which a thru-bolt is passed along the longitudinal axis of the grip member. Such thru-bolt secures together the two ends of a yoke of a tool handle, and also prevents detachment of the grip from the yoke. Disadvantageously, however, these tool handle designs require components in addition to the yoke and grip member, namely an additional thru-bolt and nut, which add to the expense and mechanical complexity in producing the tool handle.

Other prior art devices have successfully eliminated the additional component problem, but at the expense of more complex assembly and increased assembling time. By way of illustration, U.S. Pat. No. 3,107,937 in FIGS. 8A and 8B of such patent disclose a cylindrical grip bar 110 having end extensions 111 adapted to be placed between holder arms 100 of a tool handle to thereby form the tool handle. The holder arms 100 were typically of metal, and the grip bar 110 of wood. Upon insertion of the end extensions 111 into openings 121 in the holder arms 100, downwardly projecting metal web portions 124 and upwardly projecting tongue portions 122 engages slots 112 and 113 to thereby secure the grip bar 110 in the handle, and the flange portions in the vicinity of the openings 121 then needed to be crimped or pinched against the end extensions 111 and the tongue 122. This design is completely unsuitable where plastics, including HDPE co-polymers and nylon plastics, are intended to be utilized for the holder arms 100 since such design depends on the material used, particularly the web portions 124 and 122, being permanently deformable when bent or crimped to thereby maintain the grip bar 110 in place. This design cannot thus be employ and is entirely unworkable when plastics are used as the yoke material.

SUMMARY OF THE INVENTION

Despite the prior art designs, a real need exists for a tool handle which may be assembled from two parts but simultaneously maintaining ease of assembly, and being particularly adapted where the materials of the tool handle, particularly the yoke arm members of the tool handle, are to be constructed of HDPE plastic or other relatively deformable material.

Accordingly, in a broad aspect of this invention, there is provided a tool handle of typical D-grip configuration for a manual implement such as a snow shovel, which may be constructed if desired of a plastic material, and which may be assembled from merely its two structural components, namely a grip member and a yoke member, and which may when assembled create a fixed structure with the grip member lockably securing the two ends of the yoke member together to form a D-shaped tool handle.

Thus in one broad aspect the present invention comprises a tool handle having a yoke member, such yoke member having at one end thereof means to permit securement to a shaft of a tool and at an opposite end thereof having two elongate arm members, with the ends thereof being in mutually spaced-apart relationship to each other. An elongated grip member, generally cylindrical in shape, is further provided, having mutually opposite ends adapted for placement between the ends of the two arm members. Each mutually opposite end of the grip member is adapted to engage a respective distal end of each of the arm members in a first position, and upon rotation to a third position to become lockingly secured at each of its ends to the arm members. Importantly, detent means is provided on at least one of i) each of the ends of the grip member; and/or ii) the distal ends of the yoke member; to allow lockable engagement of the grip member to the yoke member when the grip member is rotated from its first position to the third position.

In a preferred embodiment, each of the mutually opposite ends of the grip member are provided with tab members protruding outwardly adapted for insertion into a respective aperture is a distal end of an arm member of the yoke. Either the tab member or the aperture is further provided with a protruding member, and a corresponding recessed portion is then correspondingly provided in the aperture, or vice versa. Such protruding member on either the tab member or the aperture, and the corresponding recessed portion on the aperture or tab member, as the case may be, upon the tab members being inserted in the corresponding apertures and the grip member then being rotated from this first position to a third position, are caused to matingly engage to thereby lockingly engage the grip member to the yoke.

Accordingly, in this further embodiment, there is further provided a yoke member having at one end thereof means to permit securement to a shaft of a tool, and at an opposite end thereof two elongate arm members, each member at its distal end having an aperture whereby each aperture of each arm member is in opposed mutually spaced-apart relationship with the other. An elongate grip member having mutually opposite ends, and tab members protruding outwardly from each of said mutually-opposite ends adapted for insertion into a respective aperture in a distal end, are also provided. Each of said tab members and each of said apertures possess, respectively, a protruding member and a corresponding recessed portion, wherein each of said tab members when inserted in said apertures and the grip member rotated from a first position to a second position, causes a condition of interference between the tab members and the aperture. Further rotation of the grip member from the second position to a third position causes the respective protruding member to matingly engage the corresponding recessed portion so as to lockingly engage the grip member to the yoke member and eliminate the interference condition.

BRIEF DESCRIPTION OF THE DRAWINGS

Further embodiments incorporating various permutations will appear from the following detailed description of the invention, taken together with the accompanying drawings, in which.

DESCRIPTION OF THE PREFERRED EMBODIMENT

Figures 1A, 1B, 1C:
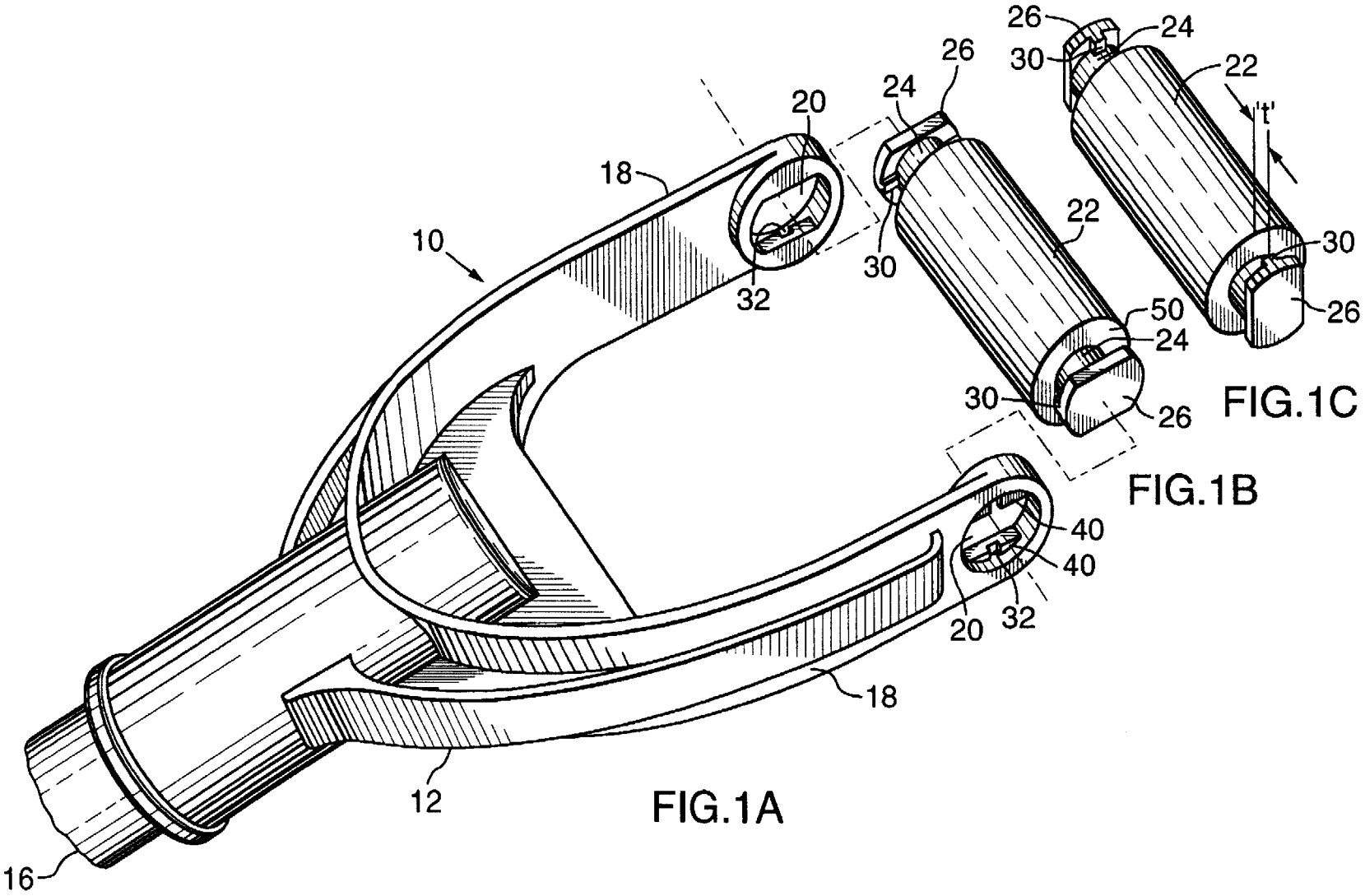
FIG. 1A is a perspective view of one part of the two component handle design of the present invention, depicting the yoke member.
FIG. 1B is a perspective view of the other part of the two-component handle design of the present member, depicting the grip member in a first position in which it would be inserted between the arms of the yoke member.
FIG. 1C is a perspective view of the grip member, shown in the position it would be rotated to, within the yoke arm members, namely the third position, to achieve securement of the grip member to the yoke.
Figure 2:
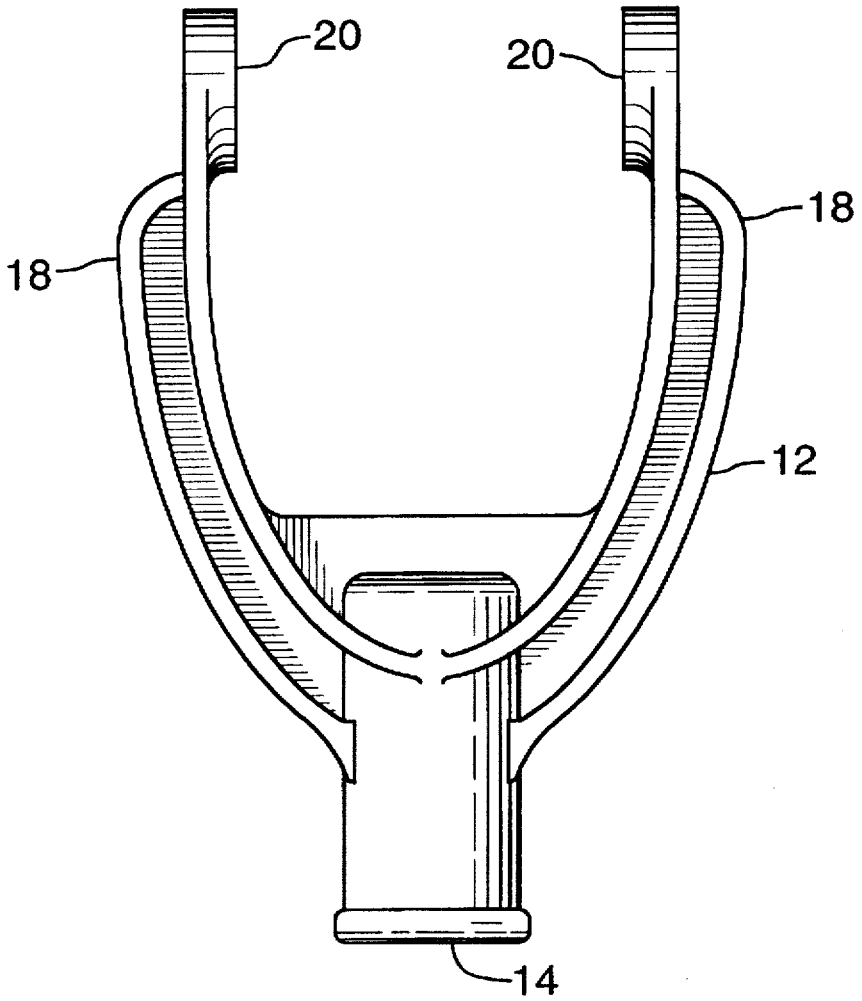
FIG. 2 is a top view of the tool handle specifically the yoke member and arms, without the grip member installed.
Figure 3:
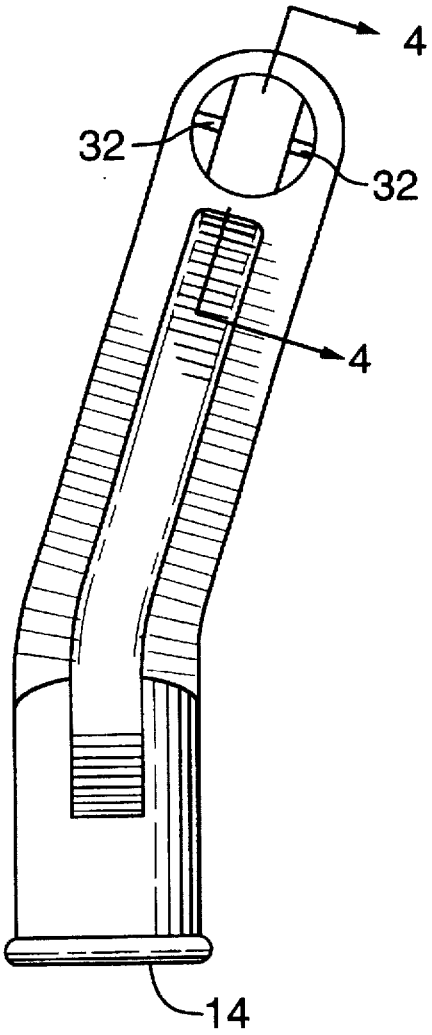
FIG. 3 is a side elevation view of the yoke member shown in FIG. 2.
Figure 5:
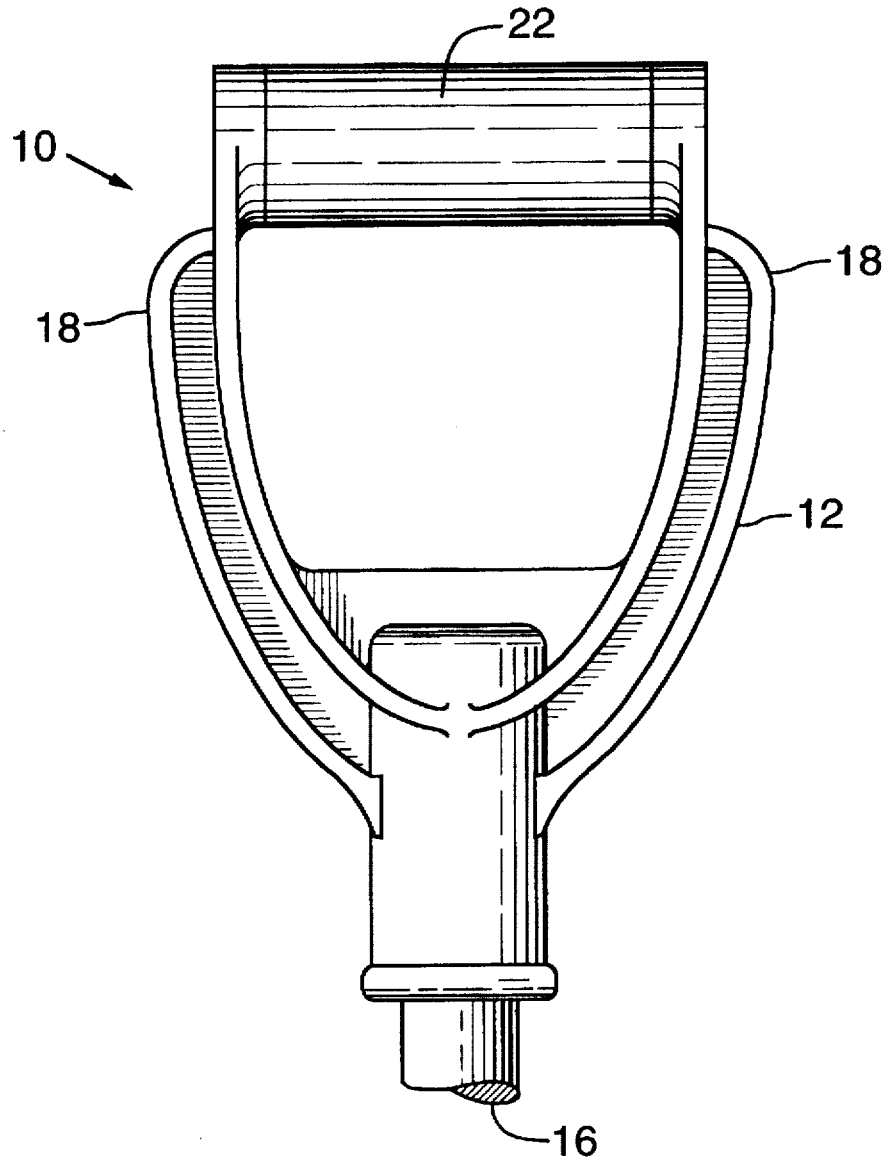
FIG. 5 is a top view of the tool handle, showing the yoke member with the grip member installed between the link arms.
Figure 6:
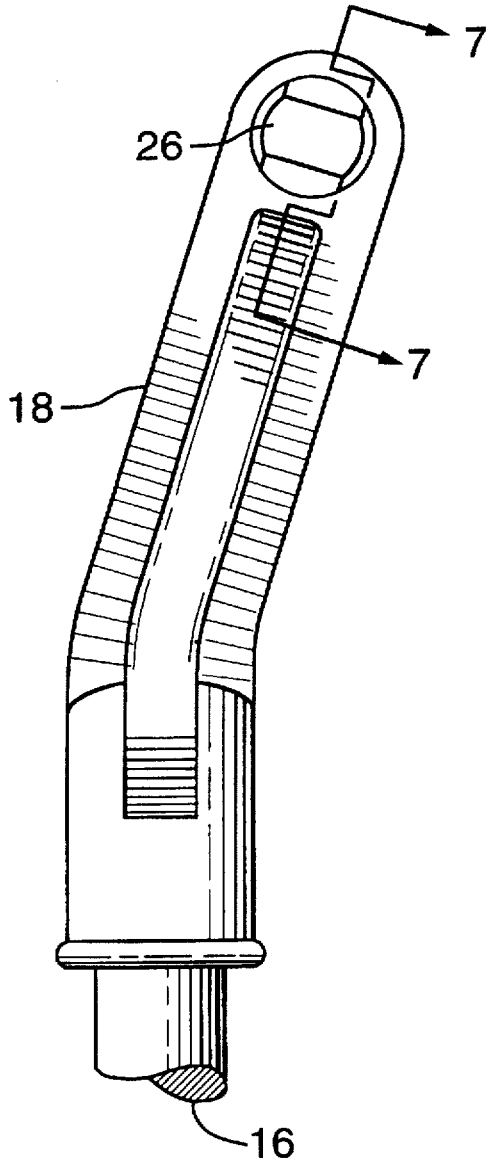
FIG. 6 is a side elevation view of the tool handle shown in FIG. 5.

FIGS. 1A, 1B, and 1C as well as FIG. 5 show the tool handle 10 of the present invention, having a yoke member 12 which at one end thereof possesses means in the form of an orifice or cavity 14 to permit placement of a shaft 16 of a tool (not shown) to allow the tool handle 10 to be secured thereto.

At the opposite end of the yoke member 12 are two elongate arm members 18, each arm member 18 at its distal end having an aperture 20 whereby each aperture 20 of each arm member 18 is in opposed spaced apart relationship to the corresponding aperture 20 on the arm member 18.

The yoke member 12 preferably of a high density polyethylene plastic (HPDE Plastic) or nylon plastic to allow injection molding thereof to the shape shown, and in the preferred embodiment is in its entirety made from and HPDE injection molded plastic. The shaft 16 to which such tool handle 10 is secured, usually by friction fit, or other means, is usually of wood but may be of other materials.

A cylindrical elongate grip member 22, having mutually opposite ends 24, is provided. Such grip member 22 is initially detached from the yoke member 12, to allow for material of a shock-absorbing nature, such as a polyethylene or foamed latex sleeve (not shown) to be fitted over such grip member 22 to assist in comfort of use of the tool handle 10, prior to being lockingly secured to the yoke member 12. Such grip member 22 is also preferably of a plastic material, such as high density polyethylene or a nylon plastic, and is in the preferred embodiment made in its entirety from a HDPH injection-molded plastic.

Tab members 26 extend from each of the mutually opposite ends 24 of the grip members 22. The grip member 22 is adapted for placement intermediate the arm members 18 so that the tab members 26 may be inserted within the respective aperture 20 of each arm member 18 as shown in FIGS. 1A–1B in a first position, and adapted to allow at least a 90° rotation within such aperture (FIG. 1C) to a third position to alow such grip member 22 to become lockingly secured, as hereinafter explained, at each of its ends 24 to the respective arm members 18.

Figure 4:
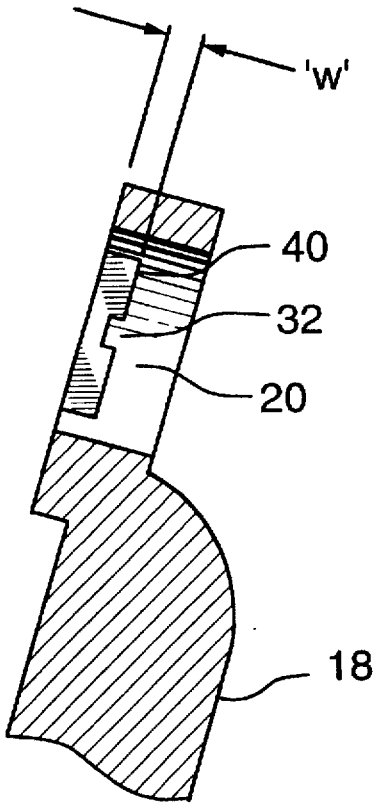
FIG. 4 is a cross-sectional view taken along plane 4—4 of FIG. 3.
Figure 7:
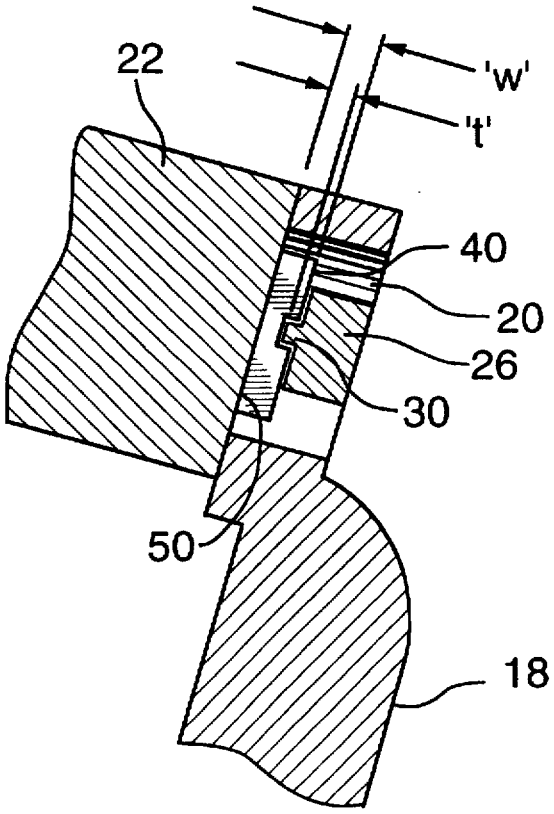
FIG. 7 is a cross-sectional view taken along plane 7—7 of FIG. 6.
Figure 9:
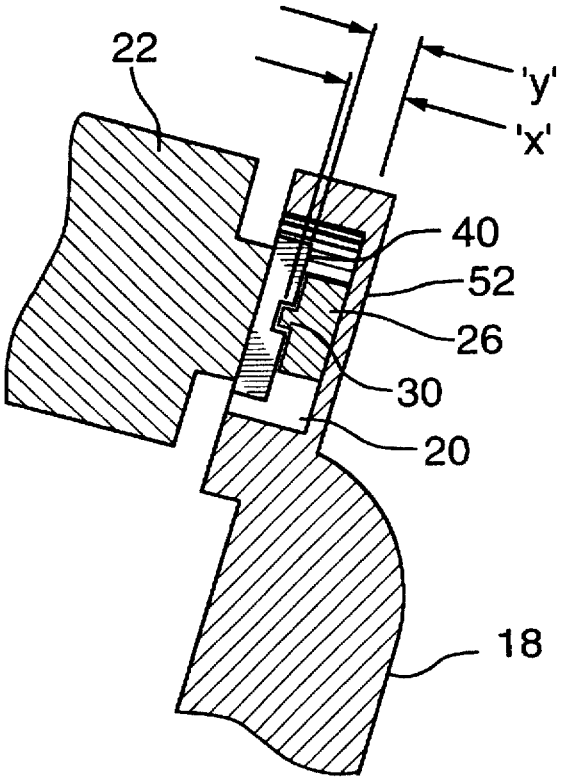
FIG. 9 is a cross-sectional view taken along plane 9—9 of FIG. 8, knowing both the grip member and one arm member of the yoke in cross-section.

Detent means, in the form of a raised protruding member 30 is provided, as shown in FIGS. 1B and 1C, and a corresponding recessed groove portion 32 in said apertures 20 is likewise provided, as shown in FIG. 1A. When the grip member 22 and in particular its tab members 26 with the protruding member 30 thereon is inserted in the corresponding aperture 20 in the arm members 18, and rotated from a first position to a second intermediate position (not shown), an interference condition is created between the protruding member 30 and surrounding portions of the aperture 20. The interference condition is caused, in the first embodiment shown in FIGS. 1–7, by dimension 't' (see FIG. 1B and FIG. 7) being smaller than dimension 'w', as shown in FIG. 4. Alternatively, in a second embodiment of the tool handle 10, the interference condition is caused by the dimension 'x' consisting of the thickness of the tab member 26 and the protruding member 30 being greater than dimensions 'y', as shown in FIG. 9.

Figure 8:
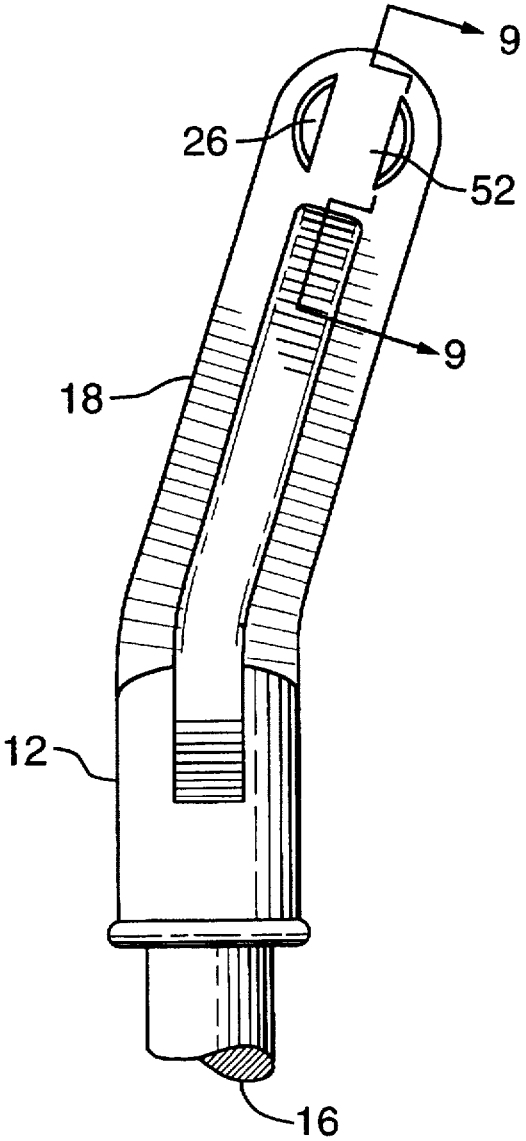
FIG. 8 is a side elevation view of an alternative embodiment design of the yoke and grip member, shown with the grip member installed within the yoke member.

Advantageously, the creation of an interference condition in the intermediate position (i.e. second position) assists in ensuring that the grip member 22 will not rotate back from the third position back to the second and/or first position to thereby become disengaged from the yoke member 12. As seen from above, two different embodiments (FIG. 7 and FIG. 9) are disclosed for ensuring an interference condition exists in the second position. In the first embodiment (FIGS. 1–7) due to dimension 't' being smaller than dimension 'w' (see FIG. 4), a tension force is created in end 24 of the grip member due to component 40 being squeezed between tab member 26, protruding member 30, and surface 50 of the grip member. In the second embodiment (FIGS. 8 & 9), due to dimension 'x' being greater than dimension 'y', protruding member 30 on tab member 26 is forcibly maintained in recessed groove portion 32 by pressure from wall 52 in aperture 20. Advantageously, the interference will gradually increase upon rotation from the first position to the second position, and upon further slight rotation to such third position where the protruding member 30 engages the recessed portion 32, the interference condition no longer exists.

In both embodiments, upon further rotation of the grip member 22 to a third position (see FIG. 7 and FIG. 9), the interference condition is removed when the protruding member 30 matingly engages the recessed portion 32, thereby preventing further rotation of the grip member 22. The two arm members 18 are then held together by the tab member 26 abutting the inner surface 40 of the aperture 20 within each arm member 18 (see FIGS. 7 and 9).

To allow rotation of the grip member 22 through a condition of interference in the second position, and on to a third position where the protruding member 30 suddenly "snaps" into the recessed area 32 of the aperture 20, it is necessary that the protruding member 30 or areas within the aperture 20 be resiliently deformable or flexible to allow the materials to deform in an interference condition, and to restore themselves to their normal dimensions when the condition of interference ceases in the third position.

Of note, it is not necessary that the protruding member 30 be situate on the tab member 22. As may accordingly now be clearly apparent to a person skilled in the art, the protruding member 30 may be situate in the aperture 20, and the recessed portion situate on the tab member 22, and the two matingly engage each other in the third position.

The manner of assembly of the tool handle is now described. In particular, to lockably install the grip member 22 within the yoke 12, the tab members 26 of the grip member 22 are inserted into the corresponding apertures 20 in each arm member as shown in FIGS. 1A with FIG. 1B.

The grip member 22 is then rotated through a condition of interference, wherein protruding member 30 and/or the aperture 20 resiliently deforms to allow such rotation. Upon rotation of the grip member 22 to a third position (FIG. 1A with FIG. 1C), the protruding member 30 matingly engages the recessed portion 32, and the interference condition is removed. The corresponding arm members 18 are prevented from being pulled apart and the grip member 22 thereby removed due to the tab members abutting surface 40 of the aperture 20.

Many variations and modifications will now occur to those skilled in the art, and the invention is not limited to the preferred embodiments shown in the drawings. For a complete definition of the invention reference is to be made to the appended claims.

I claim:

1. A tool handle comprising:

a yoke member having at one end thereof means to permit securement to a shaft of a tool, and at an opposite end thereof having two elongate arm members, the distal ends thereof being in spaced-apart relationship to each other;

an elongated grip member having mutually opposite ends adapted for placement intermediate said spaced-apart distal ends, each mutually opposite end thereof adapted to engage a respective distal end of each of said arm members in a first position, and upon rotation to a third position to become lockingly secured at each of its ends to said arm members; and detent means on at least one of i) the ends of said grip member;

ii) the distal ends of said arm members for lockable engagement of said grip member to said yoke member when said grip member is rotated from said first position to said third position.

2. A tool handle as claimed in claim 1, said grip member at each of its ends having protruding tab members;

each of said arm members at its distal end having an aperture whereby each aperture is in mutually opposed spaced apart relationship with the other; and each of said tab members insertable within the corresponding aperture in the respective distal end of said arm members.

3. The tool handle as claimed in claim 2, said detent means comprising said tab members each having a protruding member, and said aperture within each distal end having a corresponding recessed portion;

wherein upon rotation of the grip member from said first position to said third position the protruding member lockingly engages the recessed portion.

4. The tool handle as claimed in claim 2, said detent means comprising said tab members each having a recessed portion, and said apertures within each distal end having a protruding member;

wherein upon rotation of the grip member from said first position to said third position, the protruding member lockingly engages the recessed portion.

5. The tool handle as claimed in claim 3, wherein rotation of said grip member from said first position to a second position intermediate said first and third position causes a condition of interference between the protruding member of the tab member and the aperture in the respective distal end; and wherein rotation from said second position to said third position eliminates said condition of interference.

6. The tool handle as claimed in claim 5, wherein at least one of:

i) the protruding member on the tab member;

ii) the aperture into which the tab member is insertable; are resiliently deformable so as to allow rotation of said grip member from said first position to said second position.

7. The tool handle as claimed in claim 4, wherein rotation of said grip member from said first position to a second position intermediate said first and third position causes a condition of interference between the protruding member of the aperture in the respective distal end and the corresponding tab member; and wherein rotation from said second position to said third position eliminates said condition of interference.

8. The tool handle as claimed in claim 7, wherein at least one of:

i) the protruding member of the aperture;

ii) the aperture into which the tab member is insertable; are resiliently deformable so as to allow rotation of said grip from said first position to said second position.

9. The tool handle as claimed in claim 5, wherein gradual rotation from said first position to said second position causes a corresponding gradual increase in the condition of interference.

10. The tool handle as claimed in claim 7, wherein gradual rotation from said first position to said second position causes a corresponding gradual increase in the condition of interference.

11. A tool handle comprising:

a yoke member having at one end thereof means to permit securement to a shaft of a tool, and at an opposite end thereof two elongate arm members, each arm member at its distal end having an aperture whereby each aperture of each arm member is in opposed mutually spaced-apart relationship with the other;

an elongate grip member having mutually opposite ends, and tab members protruding outwardly from each of said mutually-opposite ends adapted for insertion into a respective aperture in said distal ends;

each of said tab members and each of said apertures having respectively a protruding member and a corresponding recessed portion wherein each of said tab members, when inserted in said apertures and the grip member rotated from a first position to a second position, cause a condition of interference between said tab members and said apertures; and wherein further rotation of said grip member from said second position to a third position causes the respective protruding member to matingly engage the corresponding recessed portion so as to lockingly engage the grip member to the yoke member and eliminate the interference condition.

12. The tool handle as claimed in claim 11, wherein at least one of:

i) the protruding member on the tab member;

ii) the aperture into which the tab member is insertable; are resiliently deformable so as to allow rotation of said grip member from said first position to said second position.

* * * * *